US009278357B2

(12) United States Patent
Hug et al.

(10) Patent No.: US 9,278,357 B2
(45) Date of Patent: Mar. 8, 2016

(54) STIRRED BALL MILL

(71) Applicant: WILLY A. BACHOFEN AG, Muttenz (CH)

(72) Inventors: Pascal Hug, Blodelsheim (FR); Frank Ronald Lang, Muttenz (CH); Berndt Joost, Lorrach (DE)

(73) Assignee: Willy A. Bachofen AG, Muttenz (CH)

( * ) Notice: Subject to any disclaimer, the term of this patent is extended or adjusted under 35 U.S.C. 154(b) by 96 days.

(21) Appl. No.: 14/021,849

(22) Filed: Sep. 9, 2013

(65) Prior Publication Data

US 2014/0041746 A1 Feb. 13, 2014

Related U.S. Application Data

(63) Continuation of application No. PCT/EP2012/054071, filed on Mar. 9, 2012.

(30) Foreign Application Priority Data

Mar. 11, 2011 (EP) ..... 11157806

(51) Int. Cl.
*B02C 17/16* (2006.01)
*B02C 17/18* (2006.01)

(52) U.S. Cl.
CPC ..... *B02C 17/16* (2013.01); *B02C 17/161* (2013.01); *B02C 17/183* (2013.01)

(58) Field of Classification Search
CPC ..... B02C 17/00; B02C 17/002; B02C 17/16; B02C 17/161
USPC ..... 241/170–172
See application file for complete search history.

(56) References Cited

U.S. PATENT DOCUMENTS

| | | | | | |
|---|---|---|---|---|---|
| 3,527,419 | A * | 9/1970 | Wienert | 241/153 |
| 4,582,268 | A * | 4/1986 | Adelmann | 241/284 |
| 4,651,935 | A * | 3/1987 | Samosky et al. | 241/65 |
| 4,754,934 | A * | 7/1988 | Ikebuchi et al. | 241/69 |
| 4,936,513 | A * | 6/1990 | Smith | 241/30 |
| 4,967,968 | A * | 11/1990 | Vitelli | 241/46.17 |
| 4,998,678 | A * | 3/1991 | Durr | 241/171 |
| 5,624,080 | A * | 4/1997 | Stehr et al. | 241/80 |
| 5,630,557 | A * | 5/1997 | Barthelmess | 241/80 |
| 5,934,581 | A * | 8/1999 | Chiappa | 241/170 |
| 6,019,300 | A * | 2/2000 | Zoz | 241/171 |
| 6,021,969 | A * | 2/2000 | Schmitt et al. | 241/171 |
| 6,460,791 | B1 * | 10/2002 | Stehr | 241/171 |
| 6,719,610 | B2 * | 4/2004 | Chou et al. | 451/28 |
| 8,702,023 | B2 * | 4/2014 | Enderle | 241/171 |

FOREIGN PATENT DOCUMENTS

| | | |
|---|---|---|
| DE | 3716587 | 2/1993 |
| EP | 1867394 | 12/2007 |
| GB | 1559201 | 1/1980 |

* cited by examiner

*Primary Examiner* — Faye Francis
(74) *Attorney, Agent, or Firm* — Merchant & Gould P.C.

(57) ABSTRACT

An agitator ball mill for the fine-grinding or dispersion of a grinding material, including a container the inner wall of which delimits a cylindrical or conical, vertically arranged grinding chamber, a grinding material inlet for feeding the grinding material into the grinding chamber, a grinding body inlet for introducing grinding bodies into the grinding chamber, and a grinding material outlet for discharging the ground or dispersed grinding material from the grinding chamber, and a rotatably driven agitator having at least one agitator element and extending in the axial direction in the grinding chamber.

16 Claims, 9 Drawing Sheets

STIRRED BALL MILL

CROSS-REFERENCE TO RELATED APPLICATION

This application is a Continuation of international application PCT/EP2012/054071, filed on Mar. 9, 2012, which claims the priority benefit of European Patent Application No. 11157806.8, filed on Mar. 11, 2011.

TECHNICAL FIELD

The present invention relates to an agitator ball mill, a process unit comprising such an agitator ball mill and a method for the fine-grinding or dispersion of a grinding material with the aid of such an agitator ball mill.

BACKGROUND

Agitator ball mills of this type are used for example for the fine-grinding or dispersion of solids in a liquid. For this purpose, agitator ball mills comprise a grinding chamber into which grinding bodies, for example in the form of grinding beads made of steel, glass or wear-resistant ceramic material are introduced up to a desired degree of filling. The degree of filling is determined among other things by the size of the grinding bodies or the consistency of the grinding material, with an as uniform as possible distribution of movement of the grinding bodies being sought. Arranged in the grinding chamber is an agitator which in the simplest case comprises a shaft having an agitator element arranged thereon which can be driven in a rotary manner in order to move the grinding bodies. For the grinding, a grinding material is introduced into the chamber which flows through the grinding chamber as often as required, depending on the desired degree of grinding.

Such agitator mills are already known from the prior art. EP 1 992 412 discloses an agitator ball mill, which comprises a vertically arranged container comprising a pot-shaped inner stator arranged therein. The agitator projects into this inner stator and comprises an annular-cylindrical rotor having tools extending in the radial direction up to close to the container wall. The grinding chamber is formed between the rotor and the container wall and is also embodied annular-cylindrical. Arranged at the lower end of the grinding chamber which is essentially closed off there is a deflection channel that leads to a narrow, annular gap-shaped discharge channel for the grinding material, said discharge channel being formed between the inner wall of the annular-cylindrical rotor and the inner stator. Centrally arranged at the upper end of this discharge channel is a screen for retaining the grinding bodies, which is however permeable for the grinding material once the latter has reached the required degree of grinding. Furthermore, return channels leading outwards in the radial direction are provided at the upper end of the discharge channel, said return channels serving to convey individual grinding bodies that have entered into the discharge channel back again into the grinding chamber. A likewise centrally arranged grinding material discharge line is arranged downstream of the screen in the direction of flow.

For a complete cleaning of the mill, in particular of the container, the rotor and the screen, as must be performed regularly when a switch is made from one grinding material to another, in the agitator grinding mill according to EP 1 992 412 the screen together with the grinding material discharge line is pulled out downwards after loosening of the corresponding screws. The container also must be unscrewed and disassembled, in order that the annular gap between the rotor and the container wall or the inner stator can be cleaned reliably and without residues remaining. Such absolutely residue-free cleaning is very particularly important for applications in the area of pharmaceuticals (but not only in this area) since the contamination of a product, for example by residues of the product previously ground with the agitator ball mill, must be avoided without fail. In this regard, the agitator ball mill described above is disadvantageous because it requires expensive dismantling and disassembly of various components of the mill, as is described above, in order to be able to perform a residue-free cleaning. After the cleaning, the reassembly then must be performed before the agitator ball mill is ready for use again and the next grinding material can be ground.

SUMMARY

It is therefore an object of the invention to propose an agitator ball mill of the aforementioned kind allowing for a much less expensive but at the same time reliable residue-free cleaning. In accordance with the invention, this object is achieved by an agitator ball mill as it is characterized by the features of the independent claim. Advantageous embodiments of the agitator ball mill according to the invention are the subject-matter of the dependent claims.

The agitator ball mill according to the invention for the fine-grinding or dispersion of a grinding material comprises a container, the inner wall of which delimits a cylindrical or conical, vertically arranged grinding chamber. Furthermore, it comprises a grinding material inlet for feeding the grinding material into the grinding chamber. Furthermore, it comprises a grinding body inlet for introducing grinding bodies into the grinding chamber, as well as a grinding material outlet for discharging the ground or dispersed grinding material from the grinding chamber. A rotatably driven agitator having at least one agitator element extends in the axial direction in the grinding chamber. When the agitator rotates in a first rotational direction, the agitator element moves the grinding bodies in the grinding chamber and conveys the grinding material from the grinding material inlet to the grinding material outlet. In the conveying direction of the grinding material, there is arranged in the grinding chamber directly upstream of the grinding material outlet a separating device which retains the grinding bodies in the grinding chamber but permits the ground or dispersed grinding material to be discharged from the grinding chamber through the grinding material outlet. Arranged at the lower end of the grinding chamber is a grinding body outlet channel running tangentially to the inner wall of the container and emerging from the grinding chamber. Conveying of the grinding bodies out of the grinding chamber through the grinding body outlet channel is performed by means of a through-flow of the grinding chamber towards its lower end, preferably in the presence of rotation of the agitator in a second rotational direction opposite to the first rotational direction.

The agitator ball mill according to the invention enables complete and residue-free cleaning, without the need to dismantle or disassemble the agitator ball mill or components of the mill. Instead, residue-free cleaning can be performed with a completely closed mill. By means of a through-flow of the grinding chamber towards its lower end, preferably in the presence of rotation of the agitator in the opposite direction, an overall downwardly directed flow running along the container wall is generated, with the effect that the grinding bodies at the location of the grinding body outlet channel are rinsed out of the grinding chamber together with the liquid through the grinding body outlet channel, since the grinding body outlet channel is arranged tangential to the inner wall of the container. This holds similarly for any residues of grinding material eventually still present in the grinding chamber and/or for other impurities. Thus, less expensive but at the same time reliable residue-free cleaning can be performed with a closed mill.

According to a further aspect of the invention, the grinding material inlet is arranged at the lower end of the grinding chamber and the grinding material outlet is arranged at the upper end of the grinding chamber. Although this arrangement of grinding material inlet and grinding material outlet is not absolutely mandatory, it is nonetheless advantageous because the overall grinding chamber is available for the grinding process and the available space is thus effectively utilised. On the other hand this means, that as the agitator is rotated in the first direction (during the grinding operation) a flow is generated with the aid of the agitator element or the agitator elements, with the aid of which the grinding material is conveyed from the lower end of the grinding chamber to the upper end of the grinding chamber.

The constructional execution and the spatial arrangement of the grinding material inlet are generally possible in different ways. According to a further aspect of the invention, the grinding material inlet for the introduction of the grinding material is formed by a grinding material inlet channel running tangentially to the inner wall of the cylindrical container and emerging into the grinding chamber. During the grinding operation, the grinding material thus flows in along the circular periphery as a result of which a vortex downward flow forms in the direction of the chamber axis. When the agitator ball mill is being started up, this facilitates the movement of the bulk of grinding bodies which collects at the lower end of the grinding chamber under the effect of gravity after the filling of the grinding chamber ("inlet booster"). In order to intensify this effect, a plurality of such grinding material inlet channels emerging tangentially into the grinding chamber can also be present.

In a further development of this aspect, the grinding material inlet channel and the grinding body outlet channel are formed by a common channel. In terms of design this is particularly low-cost, inasmuch as only a single such tangentially arranged channel must be provided. The latter is used during the grinding operation as a grinding material inlet (with the already described "inlet booster" function), while the same channel is used during the cleaning operation as a grinding body outlet, through which the grinding bodies and any residues of grinding material and/or other impurities are rinsed out of the grinding chamber.

According to a further aspect of the invention, the grinding body inlet is formed by a separate grinding body opening arranged at the upper end of the grinding chamber, said opening being closable. The arrangement of the grinding body inlet at the upper end of the grinding chamber permits straightforward filling of the grinding chamber under the effect of gravity (i.e. without movement of the agitator), whilst the ability of the grinding body inlet to be closed serves to prevent grinding material from escaping during the grinding operation. For example, a spout having a retractable stopper is conceivable as a specific embodiment.

The type of the agitator and its mode of operation can generally be embodied in diverse ways. According to a further aspect of the invention the agitator comprises a shaft on which at least one agitator element is arranged. The number of agitator elements and their type of execution is adapted to the intended purpose, wherein in general they must generate the directed flow from the grinding material inlet to the grinding material outlet. Apart therefrom, however, they can be adapted to the intended purpose. For example, the agitator element or agitator elements can be embodied as an accelerator, an agitator disc, a conveyor worm, a screw conveyor, a paddle wheel, a pump impeller or an angled disc, or combinations thereof.

According to a further aspect of the invention, the separating device is arranged centrally in the region of the upper end of the grinding chamber and extends from an upper end wall of the grinding chamber, into the latter. This allows the grinding material outlet to also be arranged centrally in the upper enclosing wall, which is straightforward in terms of design. It also offers the advantage that the grinding bodies that are urged outwards due to their large mass cannot clog up the separating device, for example a screen. In principle, however, it is also conceivable to arrange the separating device at the upper end of the cylindrical container wall, with the grinding material outlet then also being arranged there. In principle both static separating devices, such as a screen for example, as well as dynamic separating devices, such as rotating separating gaps for example, come into consideration as separating devices.

According to a specific development of the aforementioned aspect of the invention, the separating device is formed by a hollow-cylindrical slotted screen having a base which is closed off at the bottom. This is a static separating device which is straightforward in design and which can also be easily arranged in the grinding chamber.

In a specific development of the aforementioned aspect of the invention, the agitator element at least partially surrounds the hollow-cylindrical slotted screen in the axial direction. The effect of this is, that in the region of the slotted screen a flow with a not inessential axial component is generated in the region of the screen, which prevents clogging of the slots and thus cleans the screen.

According to a further aspect of the invention, the container is arranged on a guide and can be moved along the guide from a first position into a second position. In the second position, the container can be tilted out of its vertical position. Easy inspection of the container can thus be carried out.

According to a further aspect of the invention, the agitator ball mill comprises means for controlling the temperature in the grinding chamber. With regard to the material to be ground this may be advantageous inasmuch as the grinding of the grinding material can be carried out particularly effectively at a specific temperature.

According to a further aspect of the invention, the grinding body inlet and/or the grinding material outlet are embodied in such a way that a cleaning nozzle can be connected to the grinding body inlet and/or the grinding material outlet in order to convey a rinsing medium through the cleaning nozzle into the grinding chamber. As a result of connecting such a cleaning nozzle, the container and the agitator can be cleaned in place without them having to be moved to another place for this purpose and without the container having to be opened ("cleaning in place"). If desired, sterilization can thus also be carried out in place ("sterilizing in place") in addition to the cleaning, in that suitable media, e.g. hydrogen peroxide, are conveyed into the grinding chamber.

A further subject-matter of the invention is a process unit comprising an agitator ball mill as is explained above in various embodiments, and further comprising an agitator drive, a pump, a drive for moving the container, a grinding body reservoir, a grinding body collection container, a grinding material reservoir and a grinding material collection container. The process unit also comprises a closed cabinet with a first compartment and a second compartment, with the agitator drive and the drive for moving the container along the guide as well as the grinding body collection container are arranged in the first compartment, and with the agitator ball mill, the pump, the grinding body reservoir, the grinding material reservoir and the grinding material collection container being arranged in the second compartment. The first compartment preferably forms an upper compartment and the second compartment forms a lower compartment. This splitting-up is advantageous inasmuch as the motors, drives and bearings of the agitator ball mill are arranged in the lower compartment which in particular can be locked, while the components relevant to the actual grinding process are accessibly arranged in the upper compartment, which is preferably open or can even be completely absent so that a kind of table is formed the body of which arranged beneath the table top is closed. Additional components for the cleaning and/or the sterilisation of the container and the agitator can additionally be mounted, for example at the side on the cabinet or on the table.

According to a further aspect of the invention, the cabinet comprises means for moving the process unit, in particular rollers, wheels or rail elements, so that the process unit is mobile and therefore the location of use of the process unit is flexible.

A further subject of the invention is a method for the fine-grinding or dispersion of a grinding material with the aid of an agitator ball mill according to the invention. The method according to the invention comprises the following steps:

a) introducing grinding bodies into the grinding chamber through the grinding body inlet (preferably without movement of the agitator);
b) supplying the grinding material into the grinding chamber through the grinding material inlet;
c) fine-grinding or dispersing the grinding material in the grinding chamber by rotation of the agitator having the at least one agitator element;
d) discharging the ground or dispersed grinding material from the grinding chamber through the grinding material outlet;
e) cleaning the grinding chamber to be free from grinding material by supplying a rinsing medium into the grinding chamber through the grinding material inlet, and discharging the rinsing medium through the grinding material outlet;
f) emptying the grinding chamber by means of a through-flow of the grinding chamber with rinsing medium towards its lower end, as a result of which the grinding bodies are conveyed out of the grinding chamber through the grinding body outlet channel running tangential to the inner wall of the container at the lower end of the grinding chamber, preferably in the presence of rotation of the agitator in the second rotational direction opposite to the first rotational direction;

wherein all method steps a) to f) are carried out with a closed agitator ball mill, without the need to open the agitator ball mill.

BRIEF DESCRIPTION OF FIGURES

Further advantageous aspects of the invention are evident from the following description of embodiments with reference to the drawings.

In the drawings, in diagrammatic representation.

DETAILED DESCRIPTION

Figure 1:
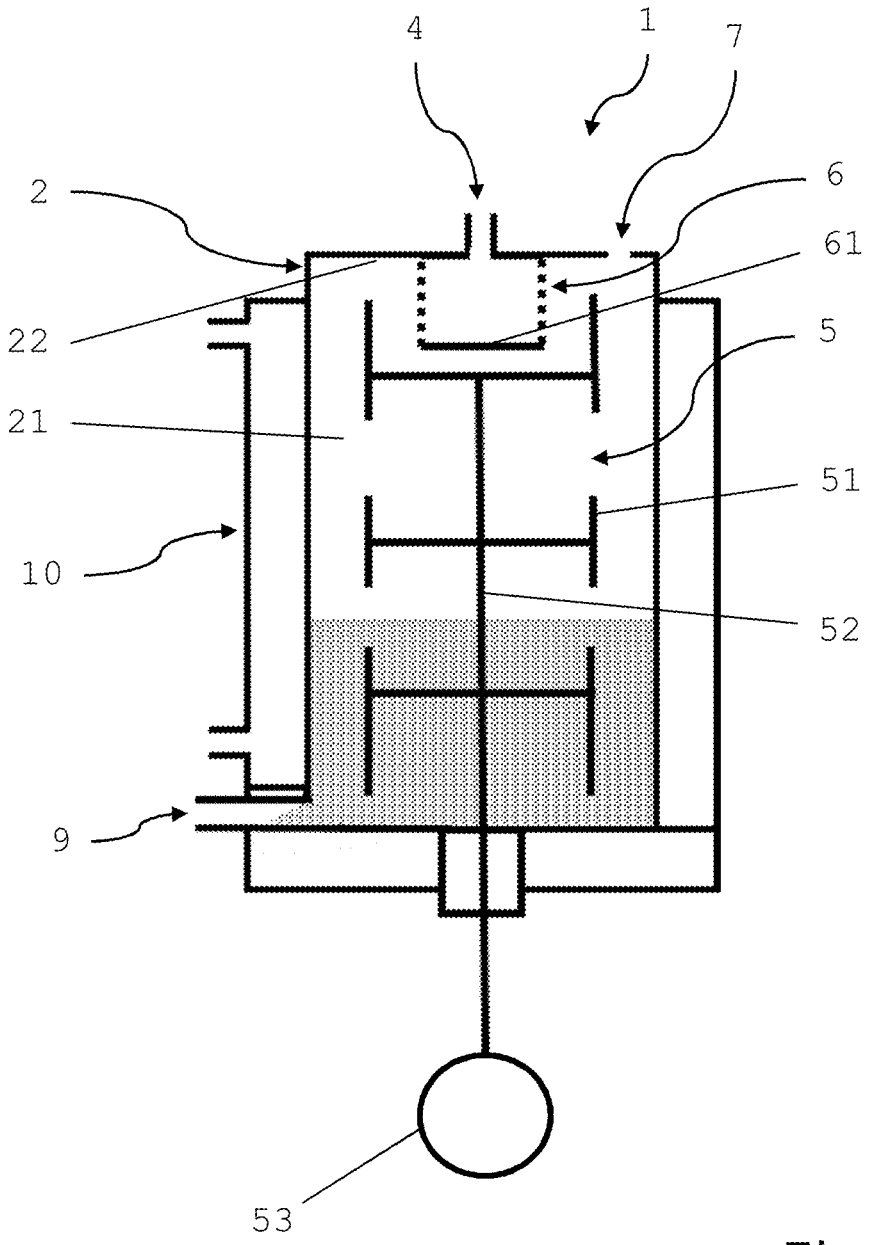
FIG. 1 shows an embodiment of an agitator ball mill according to the invention in a longitudinal cross-section.

The embodiment of the agitator ball mill 1 represented in FIG. 1 comprises a container 2, the inner wall of which delimits a circular-cylindrical, vertically arranged grinding chamber 21 in which grinding bodies are located according to FIG. 1. Arranged at the lower end of grinding chamber 21 is a channel 9 running tangentially to the inner wall of container 2 and emerging from the grinding chamber, said common channel 9—as will be explained below—serving both as a grinding material inlet channel 3 (see FIG. 2) and as a grinding body outlet channel 8 (see FIG. 3). A grinding material outlet 4 for discharging the ground or dispersed grinding material from the grinding chamber 21 is arranged in an upper end wall 22 at the upper end of grinding chamber 21. An agitator 5 rotatably driven by means of an agitator drive 53 extends in the axial direction in the grinding chamber 21. Agitator 5 comprises a shaft 52 having a plurality of agitator elements 51 arranged on this shaft 52, said agitator elements rotating in a first rotational direction (see direction of the arrow in FIG. 2) in the grinding chamber 21 as the agitator 5 is rotated, thereby conveying the grinding material from the grinding material inlet 9 to the grinding material outlet 4. A separating device in the form of a static cylindrical slotted screen 6 having a closed bottom 61 is arranged centrally in the region of the upper end of the grinding chamber 21 directly upstream of the grinding material outlet 4 with respect to the direction of conveyance of the grinding material. The slotted screen 6 extends from the upper end wall 22 into the grinding chamber 21. The uppermost agitator element arranged on shaft 52 at least partially surrounds slotted screen 6 in the axial direction in order to generate a flow having a not inessential flow component along the slotted screen 6 during rotation, said flow preventing clogging of the slotted screen 6. A grinding body inlet 7 for feeding grinding bodies into grinding chamber 21 is also provided in the upper end wall 22, said grinding body inlet being closable.

Figure 3:
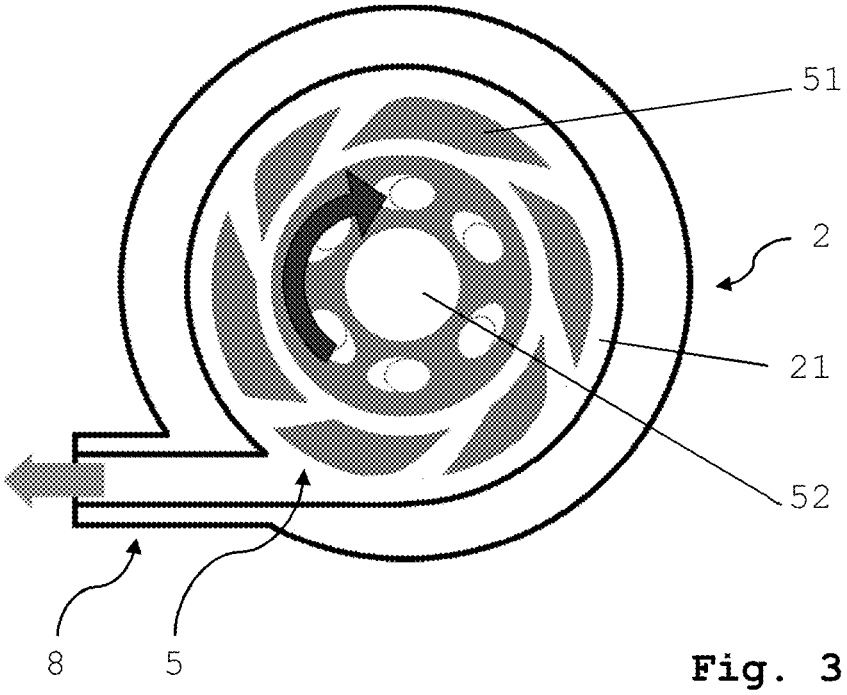
FIG. 3 shows the horizontal cross-section of FIG. 2, but with the agitator ball mill during the emptying of the grinding bodies.

As can be seen from FIG. 3 common channel 9, which at the lower end of grinding chamber 21 runs tangentially to the inner wall of container 2, also serves as a grinding body outlet channel 8 for conveying the grinding bodies out of the grinding chamber 21. As the grinding bodies are conveyed out of the grinding chamber 21, a flow is passed through the grinding chamber 21 towards its lower end, wherein agitator 5 with the agitator elements arranged thereon is preferably driven in a second rotational direction which is opposite to the first rotational direction (see direction of the arrow in FIG. 3).

As can be seen further from FIG. 1, the temperature in the grinding chamber can be controlled. For this purpose, a chamber 10 surrounding grinding chamber 21 is provided in FIG. 1 through which a heating medium or a cooling medium can flow and which thus represents a means for controlling the temperature in the grinding chamber.

Figure 2:
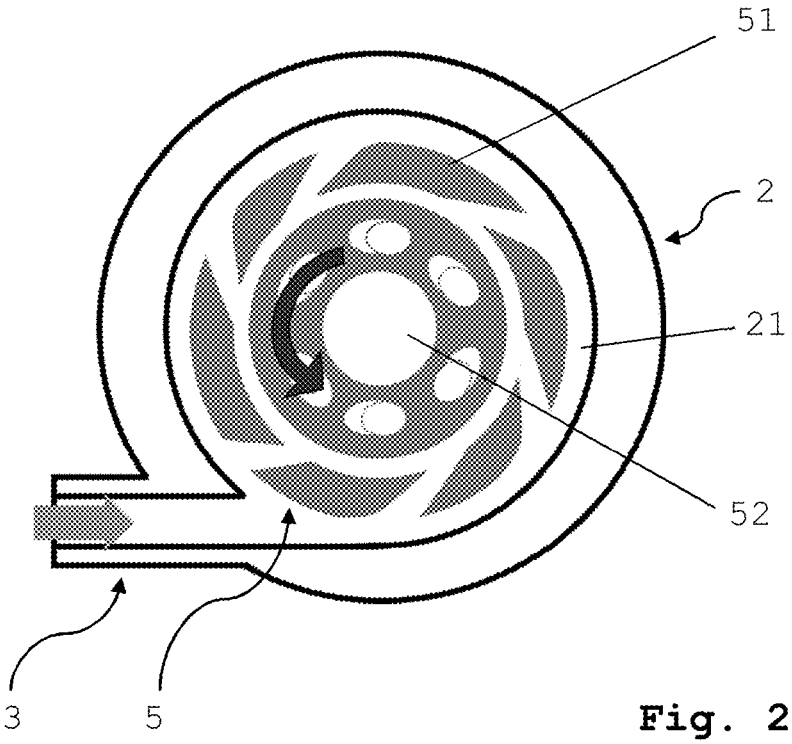
FIG. 2 shows a horizontal cross-section through the embodiment of the agitator ball mill according to the invention shown in FIG. 1, during the grinding operation.

In the respective horizontal cross-sectional view of the agitator ball mill shown in FIG. 2 and FIG. 3, agitator element 51 of agitator 5 is embodied as an accelerator. As mentioned above, channel 9 arranged tangentially to the inner wall of container 2 (FIG. 1) serves as a grinding material inlet channel 3 during the grinding operation, so that the grinding material flows tangentially into the grinding chamber 21 in the direction of the rotating accelerator. The start-up of the agitator ball mill filled with the grinding bodies is thus facilitated, because the bulk of grinding bodies arranged at the bottom of grinding chamber 21 can be moved more easily through the tangential in-flow of the grinding material into grinding chamber 21 ("inlet booster"). Moreover, the conveying effect of the accelerator is thus intensified. A vortex downward flow is thus generated in the grinding chamber 21, as a result of which the bulk of grinding bodies in the vertically arranged grinding chamber 21 is fluidised completely and practically homogeneously even without the need of narrow gaps. As already mentioned, a plurality of such tangentially arranged grinding material inlet channels can also be provided.

It can be seen from FIG. 3 that channel 9 arranged tangentially to the inner wall of container 2 (FIG. 1) serves as a grinding material outlet channel 8 during conveyance of the grinding bodies out of the grinding chamber 21. Agitator element 51 is rotated in the second rotational direction to convey the grinding bodies out of the grinding chamber 21. This leads to an overall downwardly directed vortex-like flow. The tangential arrangement of the grinding body outlet channel 8 enables the complete emptying of the grinding chamber 21, since the grinding bodies which are moved in a circle leave grinding chamber 21 in the direction of the grinding body outlet channel 8 arranged tangentially to the inner wall of container 2 due to their tangential speed component.

Figure 4:
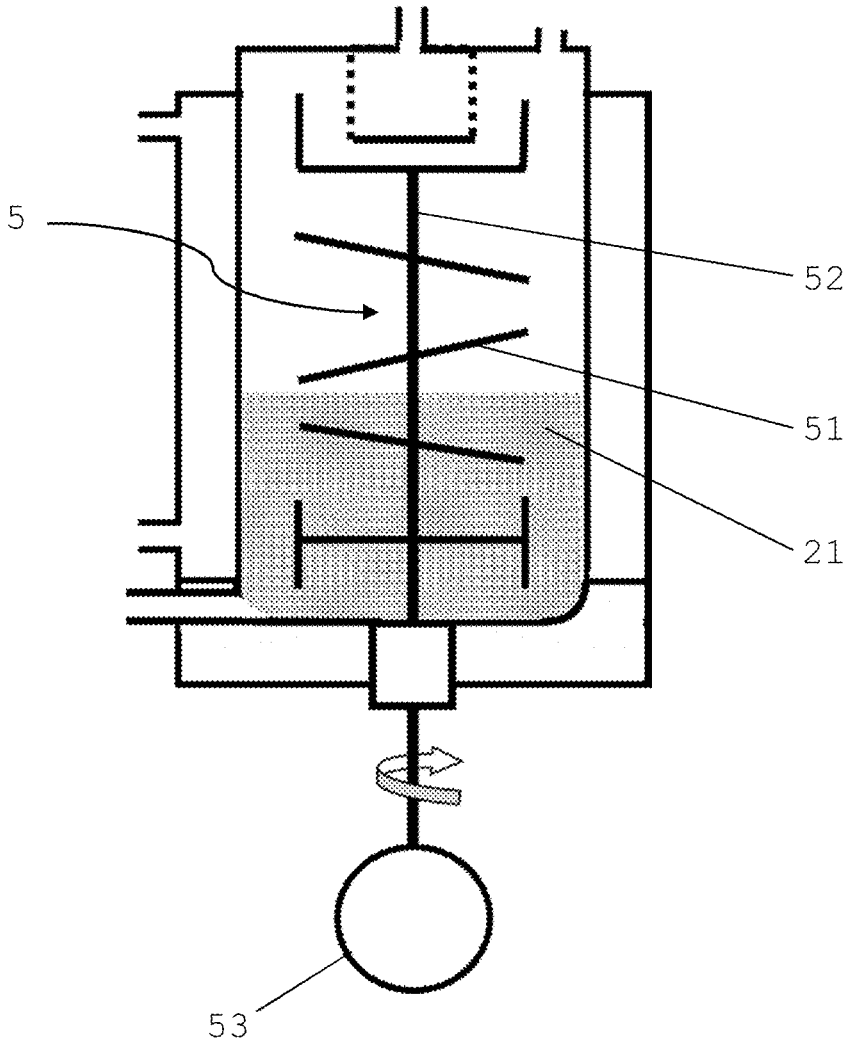
FIG. 4 shows a further embodiment of an agitator ball mill according to the invention with a special embodiment of the agitator element.
Figure 5:
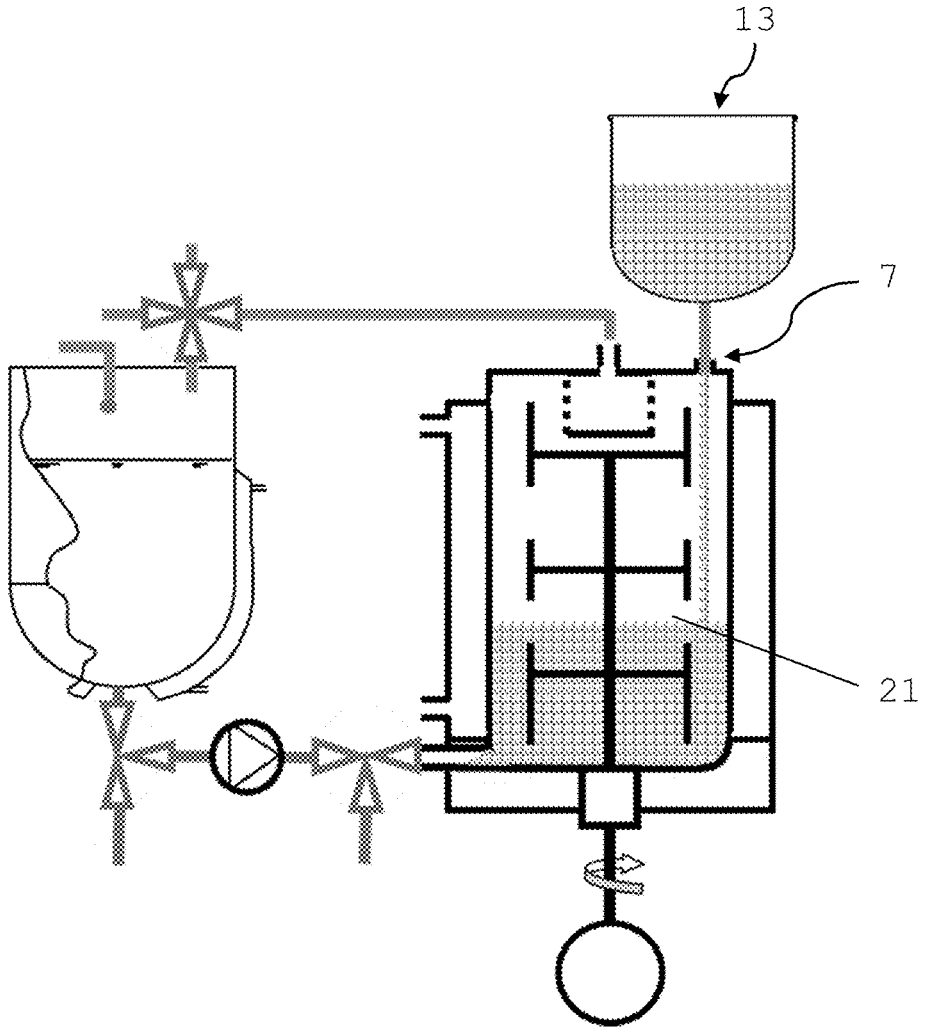
FIG. 5 shows the embodiment of the agitator ball mill according to the invention of FIG. 1 equipped with additional components, during filling with grinding bodies.

FIG. 4 shows a further embodiment of an agitator ball mill having a basically similar design as in FIG. 1. An agitator 5 with a shaft 52 driven by means of an agitator drive 53 is again arranged in the grinding chamber 21. However, in the embodiment according to FIG. 4 individual agitator elements 51 are embodied as obliquely arranged discs in relation to shaft 52.

The operation of the embodiment of the agitator ball mill according to the invention as shown in FIG. 1 is explained in the following, more precisely with the aid of FIG. 5-FIG. 9. In this regard, the embodiment of the agitator ball mill of FIG. 1 is represented in each case in FIG. 5-FIG. 9, and is equipped with additional components. The solid arrows in the respective multi-way valves indicate which valves are open in the respective case.

First, a grinding body reservoir 13 is connected to grinding body inlet 7 (FIG. 5), and the grinding bodies fall under the effect of gravity into the grinding chamber 21 until a desired degree of filling of the grinding chamber 21 is reached. The filling of grinding chamber 21 preferably takes place without the agitator being moved (i.e. with an idle agitator), but may also be performed with a rotating agitator. The grinding body inlet 7 is closed after the filling of grinding chamber 21 with grinding bodies.

Figure 6:
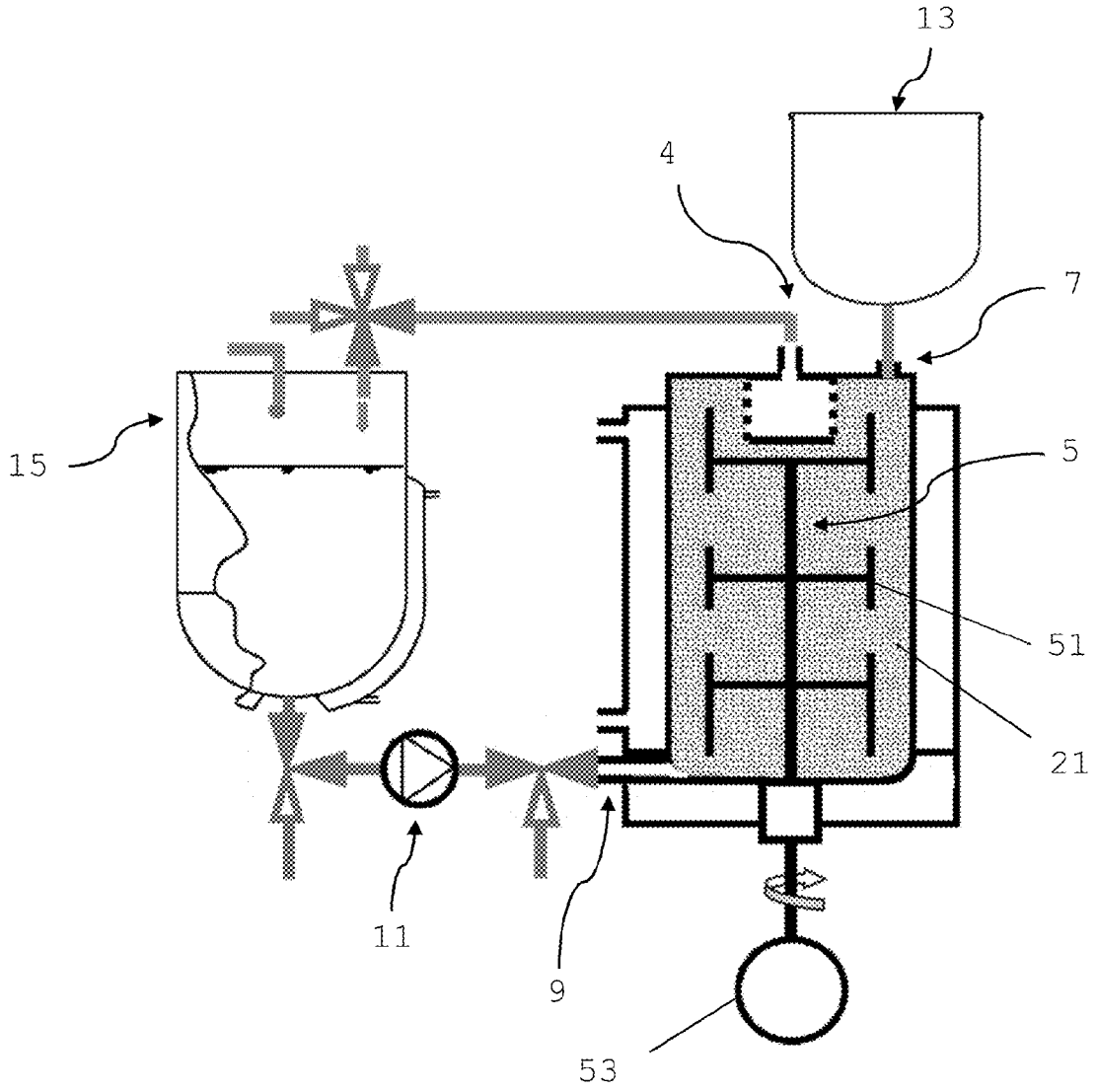
FIG. 6 shows the embodiment of the agitator ball mill according to the invention of FIG. 1 equipped with the additional components of FIG. 5, during the grinding process.

In FIG. 6 the agitator ball mill is represented during the grinding operation. By means of a pump 11, the grinding material is pumped out of a grinding material reservoir 15 into the grinding chamber 21 via the common channel 9 which runs tangentially to the inner wall of container 2. During start-up, the already described "inlet booster" effect is used which facilitates setting in motion the bulk of grinding bodies arranged at the bottom of the grinding chamber after the filling of grinding chamber 21. A vortex downward flow is generated in the grinding chamber 21, wherein a distribution of the grinding bodies that is homogeneous viewed over the length and the periphery of grinding chamber 21 results after fluidisation of the grinding bodies has taken place. The resulting flow is directed as a whole from the grinding material inlet channel formed by channel 9 towards the grinding material outlet 4. The grinding bodies essentially transmit impact, shearing and frictional forces to the grinding material, as a result of which the grinding material is ground. In order to achieve a finer degree of grinding, it is possible to re-feed the grinding material to the grinding chamber 21 again for being ground again. For this purpose, in the present embodiment of the agitator ball mill the grinding material discharged from the grinding chamber 21 through the grinding material outlet 4 is guided back into grinding material reservoir 15 in order to be fed once again through common channel 9 into the grinding chamber 21 (circulation operation).

Figure 7:
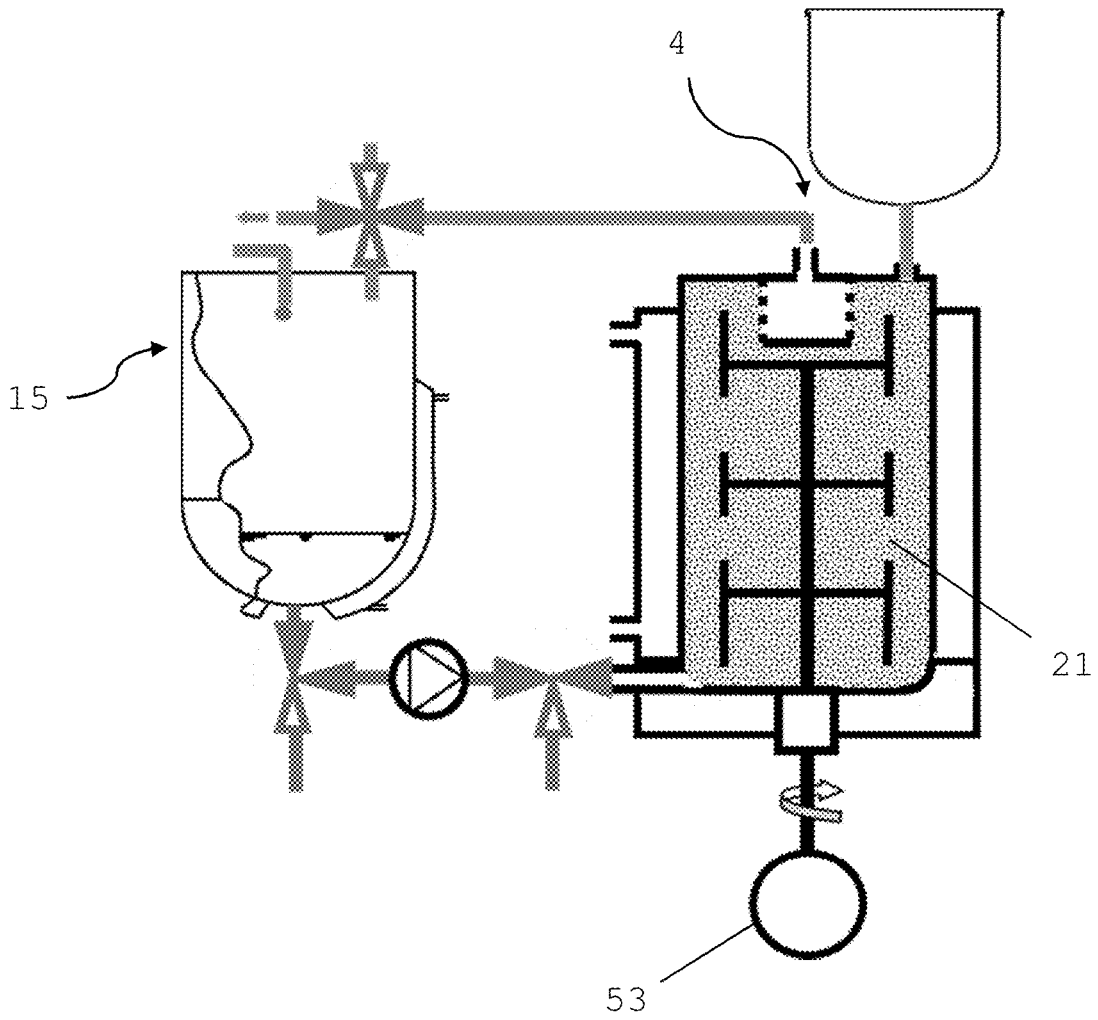
FIG. 7 shows the embodiment of the agitator ball mill according to the invention of FIG. 1 equipped with the components of FIG. 5, during the emptying of the grinding material.

As soon as the desired degree of grinding is reached, the emptying of the grinding material takes place and the grinding material is discharged through the grinding material outlet 4, as represented in FIG. 7. The grinding material reservoir is gradually emptied and the grinding material is pumped out of the grinding chamber 21, however, now it does not get back to grinding material reservoir 15 again, but rather flows into a grinding material collection container 16, for example (see FIG. 10).

Figure 8:
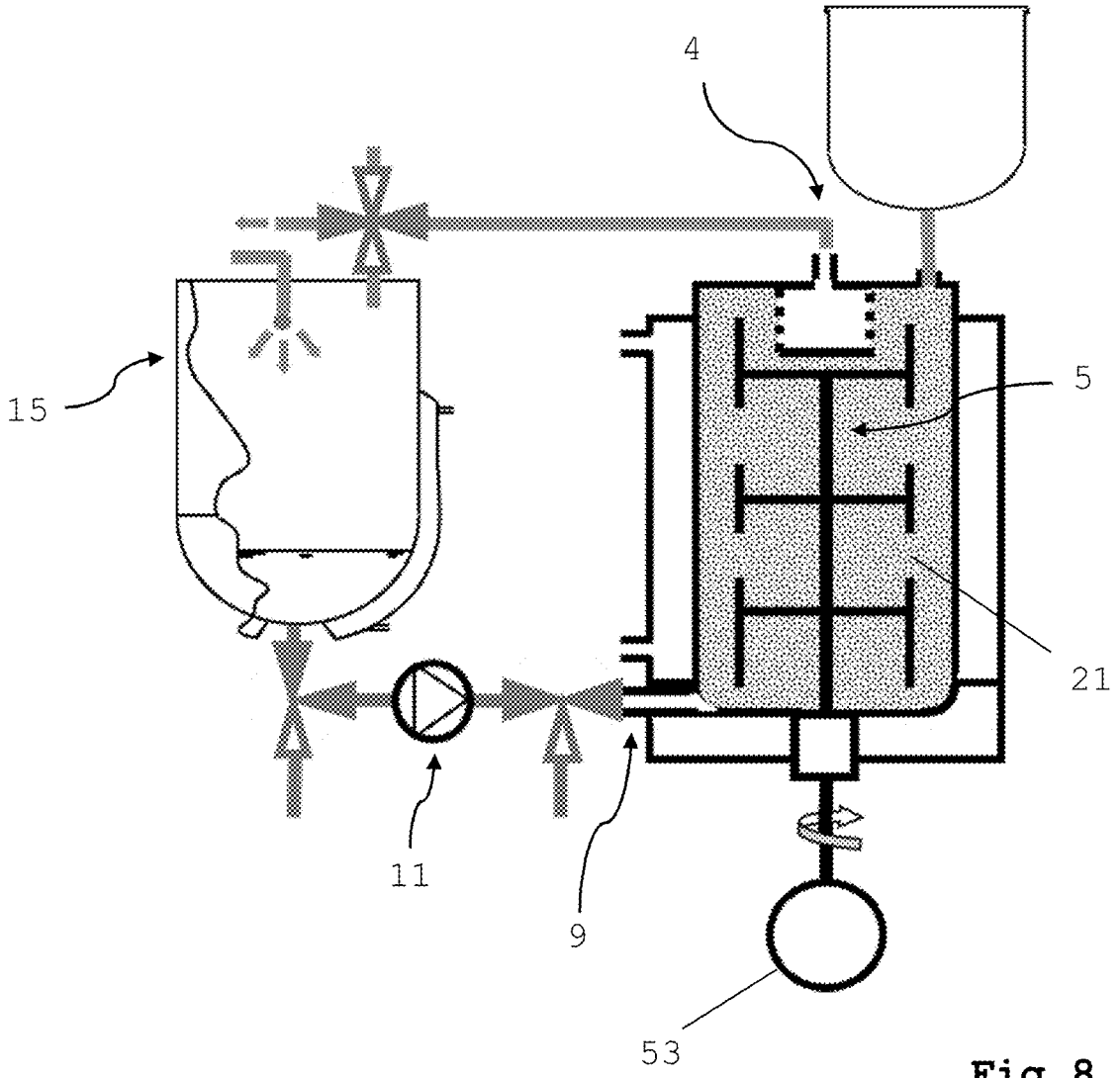
FIG. 8 shows the embodiment of the agitator ball mill according to the invention of FIG. 1 equipped with the components of FIG. 5, during the rinsing operation.

FIG. 8 represents how the cleaning of the agitator ball mill is performed, with a rinsing medium now being fed into the grinding material reservoir 15. The rinsing medium is pumped through the channel 9 into the grinding chamber 21 by means of the pump 11, similar to the grinding material during the grinding operation before. The agitator 5 is driven in the first rotational direction by means of the agitator drive 53. After having flown through grinding chamber 21, the rinsing medium is pumped out through the grinding material outlet 4 and is discharged.

Figure 9:
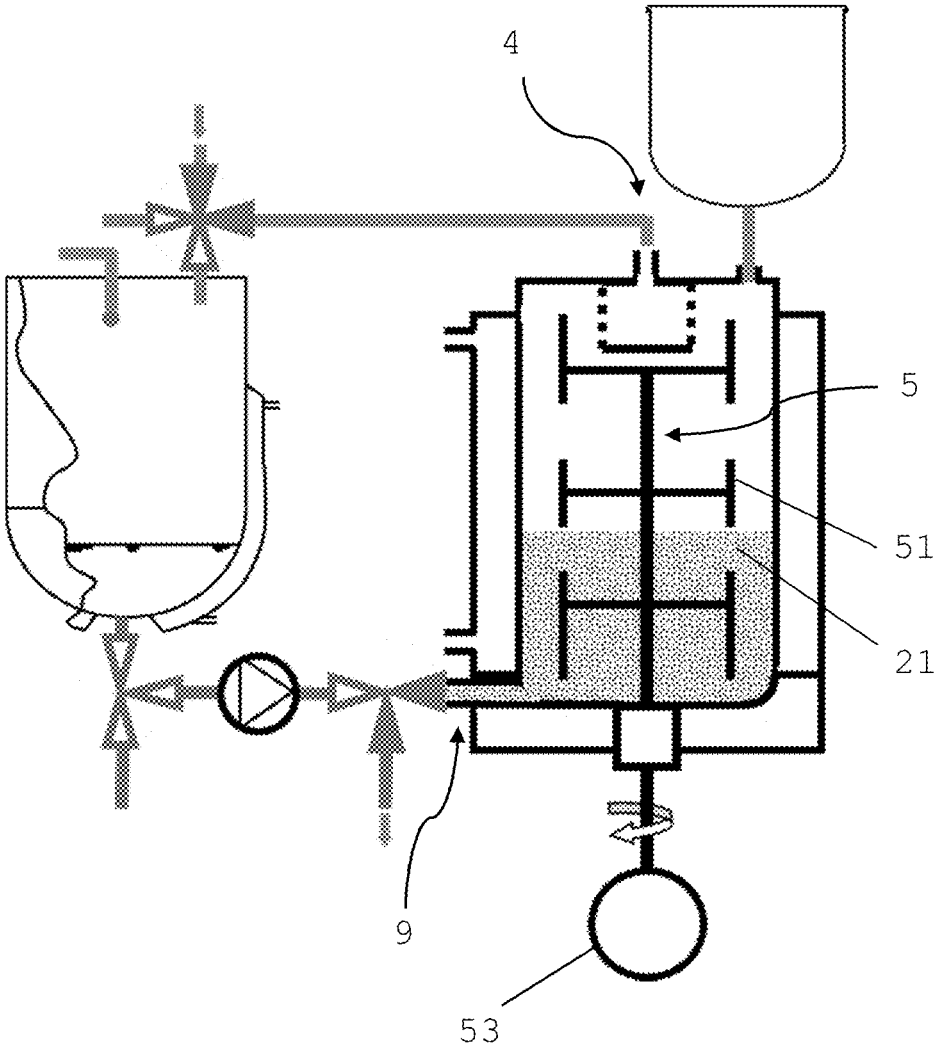
FIG. 9 shows the embodiment of the agitator ball mill according to the invention of FIG. 1 connected with the components of FIG. 5, during the emptying of the grinding bodies.

Once cleaning has been completed, the conveying of the grinding bodies out of grinding chamber 21 can be performed (emptying of grinding bodies), this being represented in FIG. 9. For the discharge of the grinding bodies from grinding chamber 21, agitator 5 is rotated by means of agitator drive 53 in a second rotational direction opposite to the first rotational direction. The agitator elements 51 also rotate in the opposite direction compared to the grinding operation or to the previously described cleaning, whereby the grinding bodies in grinding chamber 21 are caused to rotate and are transported overall in the downward direction. As the grinding bodies reach the lower end of the grinding chamber, they are conveyed out through the common channel 9 arranged tangentially to the inner wall of the grinding chamber 21. In addition, in this embodiment a rinsing medium is introduced into grinding chamber 21 through the grinding material outlet 4, facilitating the conveying-out of the grinding bodies and producing an additional cleaning effect. To achive this, the grinding material outlet 4 is preferably embodied such that a nozzle can be connected. Alternatively or in addition, the grinding body inlet 7 can of course also be embodied such that a nozzle can be connected thereto, so that the rinsing medium may also be fed through grinding body inlet 7 into the grinding chamber 21.

Figure 10:
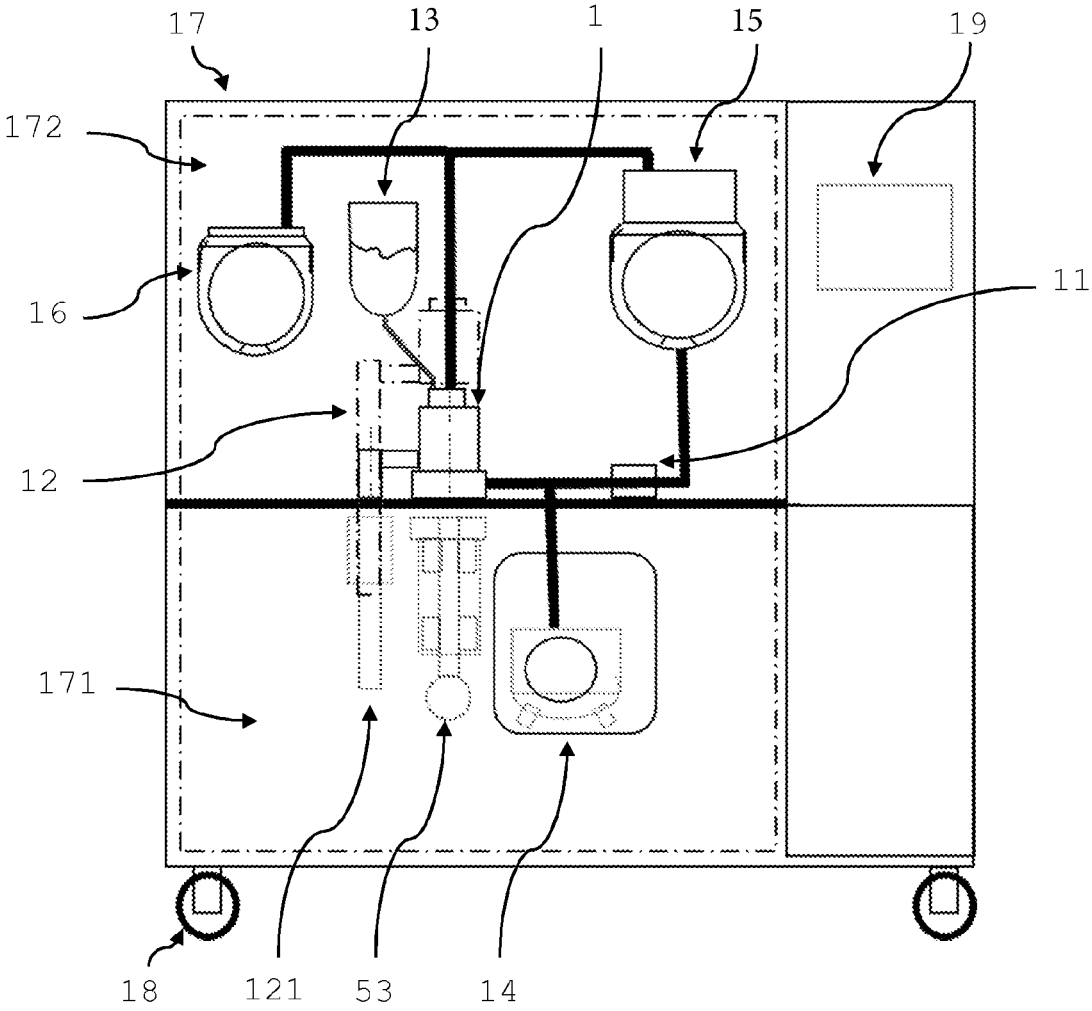
FIG. 10 shows an embodiment of a process unit according to the invention comprising the agitator ball mill according to the invention.

FIG. 10 represents an embodiment of a process unit according to the invention. The represented process unit is mobile. The process unit comprises an agitator ball mill 1 according to the invention, an agitator drive 53, a pump 11, a drive 121 for moving the container, a grinding body reservoir 13, a grinding body collection container 14, a grinding material reservoir 15 and a grinding material collection container 16, which are arranged in a cabinet 17 having a first (lower) compartment 171 and a second (upper) compartment 172. The agitator drive 53 and the drive for moving the container along the guide 12 as well as the grinding body collection container 14 are arranged in the first (lower) compartment 171. The agitator ball mill 1, the pump 11, the grinding body reservoir 13, the grinding material reservoir 15 and the grinding material collection container 16 are arranged in the second (upper) compartment. The process unit further comprises a control unit 19. The mobile process unit, which comprises rollers 18 for movement so that it can be moved in a straightforward manner to a desired location and be arrested there, may for example be embodied such that second (upper) compartment 172 is readily accessible, whilst the first (lower) compartment is usually locked. Alternatively, the process unit can also be embodied to form a kind of "table" on the "table top" of which the aforementioned components of the second (upper) compartment are arranged, whilst the components of the first (lower) compartment are arranged in a "body" beneath the table top.

The invention has been described with the aid of the aforementioned embodiments of the agitator ball mill. However, the invention is not to be understood as being limited to these embodiments. Rather, numerous modifications and variants of such an agitator ball mill are conceivable without departing from the technical teaching. Only by way of example it is to be mentioned, that the shape and the diameter of the grinding material inlet and the grinding body discharge are constituted conical or funnel-shaped.

The invention claimed is:

1. An agitator ball mill for the fine-grinding or dispersion of a grinding material, comprising a container the inner wall of which delimits a cylindrical or conical, vertically arranged grinding chamber, a grinding material inlet for feeding the grinding material into the grinding chamber, a grinding body inlet for introducing grinding bodies into the grinding chamber, and a grinding material outlet for discharging the ground or dispersed grinding material from the grinding chamber, and a rotatably driven agitator having at least one agitator element and extending in the axial direction in the grinding chamber, the agitator element moving the grinding bodies in the grinding chamber as the agitator rotates in a first rotational direction and thereby conveying the grinding material from the grinding material inlet to the grinding material outlet, wherein in the conveying direction of the grinding material there is arranged in the grinding chamber directly upstream of the grinding material outlet a separating device retaining the grinding bodies in the grinding chamber but permitting the ground or dispersed grinding material to be discharged from the grinding chamber through the grinding material outlet, characterised in that a grinding body outlet channel running tangentially to the inner wall of the container and emerging from the grinding chamber is arranged at the bottom of the grinding chamber so that a complete emptying of the grinding bodies out of the grinding chamber through the grinding body outlet channel is possible by a flow through the grinding chamber towards its bottom.

2. The agitator ball mill according to claim 1, wherein the grinding material inlet is arranged at the bottom of the grinding chamber and the grinding material outlet is arranged at the upper end of the grinding chamber.

3. The agitator ball mill according to claim 1, wherein the grinding material inlet for the feeding of the grinding material is formed by a grinding material inlet channel running tangentially to the inner wall of the cylindrical container and emerging into the grinding chamber.

4. The agitator ball mill according to claim 3, wherein the grinding material inlet channel and the grinding body outlet channel are formed by a common channel.

5. The agitator ball mill according to claim 1, wherein the grinding body inlet is formed by a separate grinding body inlet opening arranged at the upper end of the grinding chamber, said opening being closable.

6. The agitator ball mill according to claim 1, wherein the separating device is arranged centrally in the region of the upper end of the grinding chamber and extends from an upper end wall of the grinding chamber into the latter.

7. The agitator ball mill according to claim 6, wherein the separating device is formed by a hollow-cylindrical slotted screen having a base closed off at the bottom.

8. The agitator ball mill according to claim 7, wherein the agitator element at least partially surrounds the hollow-cylindrical slotted screen in the axial direction.

9. The agitator ball mill according to claim 1, wherein the container is movable along a guide from a first position to a second position, and wherein in the second position the container can be tilted out of its vertical position.

10. The agitator ball mill according to claim 1, further comprising means for controlling the temperature in the grinding chamber.

11. The agitator ball mill according to claim 1, wherein at least one of a group comprising the grinding body inlet and the grinding material outlet is configured to connect a cleaning nozzle to at least one of a group comprising the grinding body inlet and the grinding material outlet in order to convey a rinsing medium through the cleaning nozzle into the grinding chamber.

12. The agitator ball mill according to claim 1, configured for a complete emptying of the grinding bodies out of the grinding chamber through the grinding body outlet channel by a flow through the grinding chamber towards the bottom in the presence of rotation of the agitator in a second rotational direction opposite to the first rotational direction.

13. A process unit for the fine-grinding or dispersion of a grinding material, comprising the agitator ball mill of claim 1, and further comprising an agitator drive, a pump, a drive for moving the container along a guide, a grinding body reservoir, a grinding body collection container, a grinding material reservoir and a grinding material collection container, wherein a closed cabinet is provided having a first compartment and a second compartment, with the agitator drive and the drive for moving the container along the guide as well as the grinding body collection container being arranged in the first compartment, and with the agitator ball mill, the pump, the grinding body reservoir, the grinding material reservoir and the grinding material collection container being arranged in the second compartment.

14. The process unit according to claim 13, being executed as a mobile process unit, wherein the cabinet comprises at least one of a group comprising rollers, wheels and rail elements for moving the process unit.

15. A method for the fine-grinding or dispersion of a grinding material with the aid of the agitator ball mill according claim 1, the method comprising:

introducing grinding bodies into the grinding chamber through the grinding body inlet;

supplying the grinding material into the grinding chamber through the grinding material inlet;

fine-grinding or dispersing the grinding material in the grinding chamber by rotation of the agitator having the at least one agitator element;

discharging the ground or dispersed grinding material from the grinding chamber through the grinding material outlet;

cleaning the grinding chamber to be free from grinding material by supplying a rinsing medium into the grinding chamber through the grinding material inlet, and discharging the rinsing medium through the grinding material outlet; and completely emptying the grinding chamber by a flow through the grinding chamber with rinsing medium towards its bottom, as a result of which the grinding bodies are conveyed out of the grinding chamber through the grinding body outlet channel running tangential to the inner wall of the container at the bottom of the grinding chamber;

wherein, all method steps are carried out with the closed agitator ball mill, without the need to open the agitator ball mill.

16. The method according to claim 15, wherein completely emptying the grinding chamber by a flow of rinsing medium through the grinding chamber towards bottom, as a result of which the grinding bodies are conveyed out of the grinding chamber through the grinding body outlet channel running tangential to the inner wall of the container at the bottom of the grinding chamber, is performed in the presence of rotation of the agitator in the second rotational direction opposite to the first rotational direction.

* * * * *